United States Patent [19]

Odermann et al.

[11] 4,372,231

[45] Feb. 8, 1983

[54] BUTTONHOLE PADDLE SWITCH POSITION SENSING ARRANGEMENT IN A SEWING MACHINE

[75] Inventors: Charles R. Odermann, Montville; John W. Wurst, Dover, both of N.J.

[73] Assignee: The Singer Company, Stamford, Conn.

[21] Appl. No.: 290,892

[22] Filed: Aug. 7, 1981

[51] Int. Cl.[3] ..... D05B 3/06; D05B 3/02

[52] U.S. Cl. ..... 112/158 B; 112/158 E; 112/277

[58] Field of Search ..... 112/158 B, 158 E, 221, 112/277, 121.11, 121.12, 65, 67

[56] References Cited

U.S. PATENT DOCUMENTS

| | | | |
|---|---|---|---|
| Re. 29,972 | 4/1979 | Herr et al. . | |
| 4,075,961 | 2/1978 | Harris | 112/277 |
| 4,159,685 | 7/1979 | Wurst et al. | 112/158 B |
| 4,248,167 | 2/1981 | Reinert . | |
| 4,301,755 | 11/1981 | Kato et al. | 112/158 E |

FOREIGN PATENT DOCUMENTS

| | | |
|---|---|---|
| 1204291 | 1/1969 | United Kingdom . |
| 2035608 | 2/1979 | United Kingdom . |

*Primary Examiner*—Peter P. Nerbun

*Attorney, Agent, or Firm*—David L. Davis; Robert E. Smith; Edward L. Bell

[57] ABSTRACT

An electronically controlled multiple pattern sewing machine is provided with an arrangement which senses when the buttonhole paddle and buttonhole presser foot are not properly positioned at the time a buttonhole pattern is selected to be sewn. Under these circumstances, an alarm is activated and stitches are not formed even though the operator may attempt to sew.

7 Claims, 2 Drawing Figures

BUTTONHOLE PADDLE SWITCH POSITION SENSING ARRANGEMENT IN A SEWING MACHINE

BACKGROUND OF THE INVENTION

This invention relates to sewing machines and, more particularly, to an arrangement for incorporation in an electronically controlled sewing machine to prevent improper sewing when a buttonhole pattern is selected and the buttonhole paddle switch and buttonhole presser foot are not properly located.

The application of electronics technology to sewing machines has resulted in a simplification in the machine-operator interface. For example, the sewing of a buttonhole pattern has been greatly simplified. The sewing of a buttonhole pattern is fully disclosed in U.S. Pat. No. 4,159,688, which issued on July 3, 1979, to Stephen A. Garron and Charles R. Odermann, the disclosure of which is hereby incorporated by reference. Simplification of the sewing of a buttonhole pattern is achieved by the electronic control of the sewing machine responding to signals generated by a buttonhole paddle switch cooperating with a buttonhole presser foot which includes a button size gauging arrangement. However, in order for the proper sewing of a buttonhole pattern, the paddle switch must be properly positioned by the operator at the start of sewing, the paddle switch being selectively movable between a retracted non-operative position and an extended operative position. If the paddle switch is not in its extended position and if the buttonhole presser foot is not moved to an initial starting position, the appropriate signals will not be generated by the paddle switch and the bottonhole will be improperly formed.

It is therefore an object of the present invention to provide an arrangement which alerts the operator that the paddle switch and presser foot are not properly positioned at the start of sewing of a buttonhole pattern.

Unfortunately, there may be times where the operator initiates the sewing of a buttonhole pattern and ignores the alarm signal for a number of stitches. The operator would then have to remove the work fabric from the sewing machine and carefully remove the stitches.

It is therefore another object of this invention to provide an arrangement which prevents stitches from being formed after selection of a buttonhole pattern unless the buttonhole paddle switch and the buttonhole presser foot are properly positioned.

SUMMARY OF THE INVENTION

The foregoing and additional objects are attained in accordance with the principles of this invention by providing an arrangement in an electronically controlled sewing machine for rendering inoperative at least one of the stitch forming instrumentalities of the sewing machine in response to the buttonhole paddle switch not being in its operative position when a buttonhole pattern is selected.

In accordance with an aspect of this invention, in addition to rendering inoperative the stitch forming instrumentality, an alarm is activated to alert the sewing machine operator of an improper operating condition.

In accordance with another aspect of this invention, when the stitch forming instrumentality is rendered inoperative, the electronic control is prevented from sequencing.

BRIEF DESCRIPTION OF THE DRAWINGS

The foregoing will be more readily apparent upon reading the following description in conjunction with the drawings wherein.

DETAILED DESCRIPTION

Figure 1:
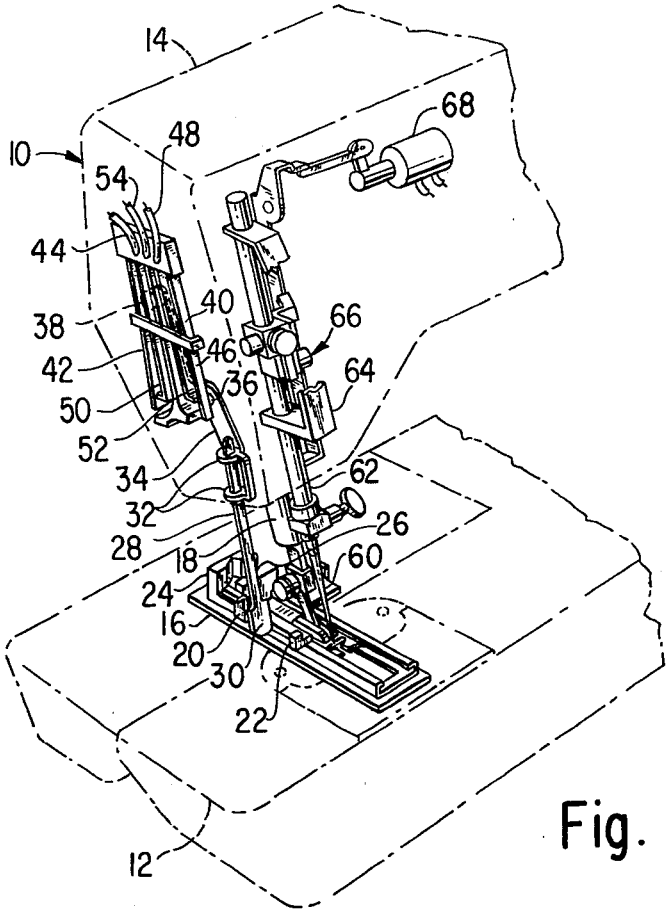
FIG. 1 is a perspective view of a portion of a sewing machine in which an arrangement constructed in accordance with the principles of this invention may be incorporated.

Referring to the drawings, wherein like elements in different figures thereof have the same reference character applied thereto, FIG. 1 illustrates in phantom lines a sewing machine casing 10 including a bed 12 and a bracket arm 14 overhanging the bed 12. The illustrated sewing machine 10 is of the electronically controlled type wherein a pattern selected by the operator is automatically sewn. For an understanding of the manner in which automatic pattern sewing may be accomplished, the reader is referred to U.S. Pat. No. 3,872,808, issued to John W. Wurst on Mar. 25, 1975, the disclosure of which is hereby incorporated by reference.

The subject invention is concerned with the sewing of a buttonhole pattern. When a buttonhole pattern is to be sewn, a buttonhole presser foot 16 is installed on the presser bar 18. The buttonhole presser foot 16 is of the type described in U.S. Pat. No. 3,877,403, which issued to Stanley J. Ketterer on Apr. 15, 1975. The buttonhole presser foot 16 includes a button size gauging arrangement. Accordingly, the buttonhole presser foot 16 includes a fixed rear stop member 20 and an adjustable front stop member 22, the distance therebetween defining the length of the buttonhole pattern being sewn, as determined by the size of button inserted between an anchor element 24 and a buttonhole gauging element 26. The sewing machine further includes a switch mechanism including a lever arm 28 terminating in a paddle 30 at its lower end. The other end of the lever arm 28 is received by openings in a pair of spaced lugs 32 formed at one end of a lever 34. The lever arm 28 may therefore be selectively raised and lowered by an operator, between a retracted non-operative position and an extended operative position, the operator extending and lowering the lever arm 28 so that the paddle 30 is between the stops 20 and 22 during the formation of a buttonhole pattern.

The lever 34 is pivoted at 36 and at the end opposite the lugs 32 has a pin 38 mounted thereon for cooperation with an electrical switch member 40. The switch member 40 includes a first fixed contact 42 connected to a wire 44, a second fixed contact 46 connected to a wire 48, a first moveable contact 50 and a second moveable contact 52, the first and second moveable contacts 50 and 52 being connected to a wire 54. The pin 38 mounted on the lever 34 is between the moveable contacts 50 and 52. When the buttonhole presser foot 16 is positioned for needle penetrations at a first end of a buttonhole pattern, the paddle 30 is in contact with the stop 20 and is pushed forward so that the lever 34 pivots about the pivot point 36 and causes the pin 38 to push the moveable contact 50 against the fixed contact 42. At the other end of the buttonhole pattern, the buttonhole presser foot 16 is moved rearward so that the stop 22 moves the paddle 30 back which causes the lever 34 to pivot about the pivot point 36, causing the pin 38 to push the moveable contact 52 against the fixed contact 46.

At the start of sewing a buttonhole pattern, it is important that the paddle 30 extend downwardly as far as possible and that the presser foot 16 be positioned so that the stop 20 pushes the paddle 30 to move the moveable contact 50 against the fixed contact 42. Unless this initial action is taken, a defective buttonhole pattern will be sewn. The arrangement according to this invention prevents this from happening.

The sewing machine 10 also includes what is commonly referred to as a skip stitch mechanism. Such a mechanism is described in U.S. Pat. No. 3,847,100, which issued to Stephen Garron on Nov. 12, 1974, the disclosure of which is hereby incorporated by reference. As is well known in the art, the sewing machine 10 includes a needle 60 carried for endwise reciprocation by a needle bar 62 mounted for lateral jogging movement in a gate 64. The connections between the sewing machine arm shaft (not shown) and the needle bar 62 for imparting needle reciprocation include a separable connection indicated generally at 66 which is referred to in the art as a skip stitch mechanism. The skip stitch mechanism 66 is operatively connected to a needle bar release solenoid 68. When the solenoid 68 is energized momentarily, it will influence interruption of needle bar reciprocation to prevent the formation of stitches. The present invention utilizes this skip stitch mechanism to prevent a buttonhole pattern from being improperly sewn.

Figure 2:
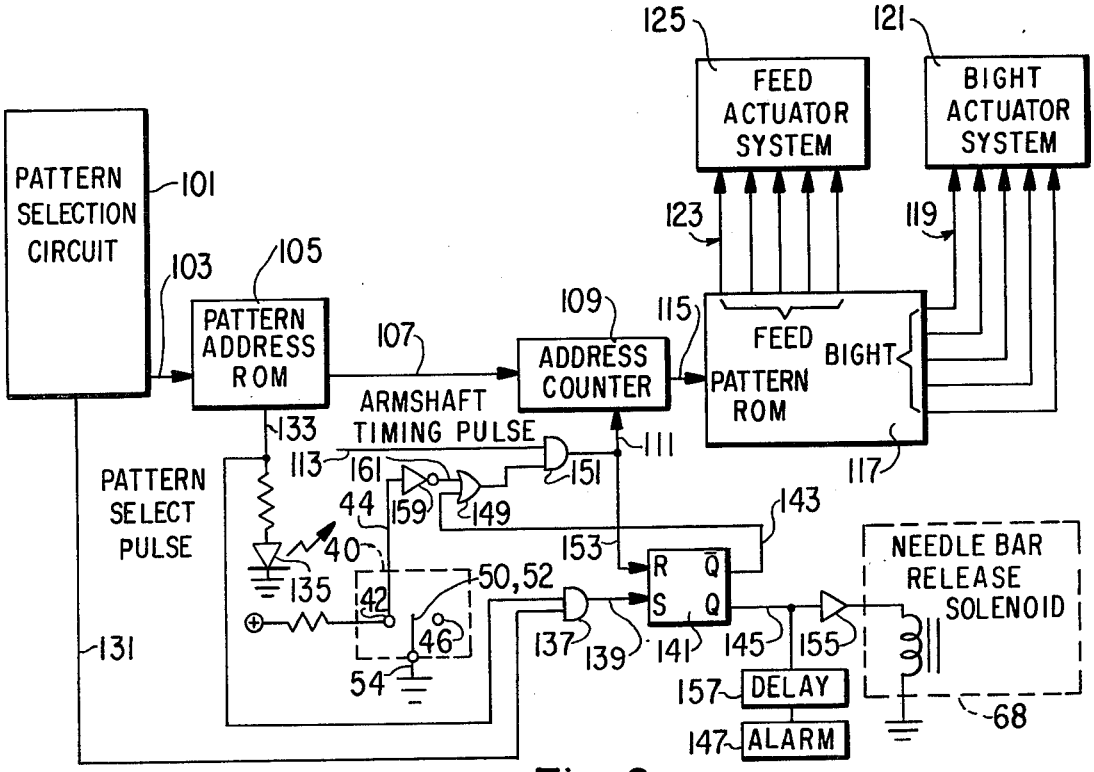
FIG. 2 is a block schematic diagram of illustrative circuitry constructed in accordance with the principles of this invention.

Referring now to FIG. 2, shown therein is a portion of the total circuitry which is responsive to operator selection of a pattern for controlling the operation of the sewing machine 10 to form stitches in a selected pattern in accordance with information stored in a memory, and also for preventing the sewing of a buttonhole pattern until the initial operating conditions of the buttonhole presser foot 16 and the paddle 30 are satisfied. The circuitry shown in FIG. 2 operates in accordance with the circuitry disclosed in the above-referenced Wurst U.S. Pat. No. 3,872,808, and includes a pattern selection circuit 101 which responds to operator selection of a desired pattern from a plurality of selectable patterns and includes operator actuable elements (not shown) disposed on the sewing machine 10. In response to operator actuation of one of those elements, the pattern selection circuit 101 provides an appropriate pattern selector code word on the leads 103 to the pattern address ROM 105. The pattern address ROM 105 provides over the leads 107 to the address counter 109 a code word representing the selected pattern. This code word on the leads 107 determines the starting point of the address counter 109 which has a count input line 111 upon which are provided pulses from an arm shaft pulse generator (not shown) over the line 113. The address counter 109 has output leads 115 which are connected to the inputs of a pattern ROM 117. The pattern ROM 117 has output lines 119 upon which are provided a digital code word for the bight actuator system 121. Additionally, the pattern ROM 117 has output lines 123 upon which are provided a digital code word for the feed actuator system 125. The bight actuator system 121 and the feed actuator system 125 are similar in construction and are adapted to convert a digital code word from the pattern ROM 117 into a mechanical position which locates the sewing machine needle in a conventional stitch forming instrumentality and provides a specific work feed for each needle penetration, as described in the above-referenced U.S. Pat. No. 3,872,808.

Whenever a new pattern is selected, or a pattern is reselected, a pattern select pulse is applied to the lead 131 from the pattern selection circuit 101. Also, the pattern address ROM 105 provides output signals for energizing pattern indicator lights, illustratively light emitting diodes, which are disposed on the sewing machine 10 in proximity to graphical indicia so that an operator is informed as to which pattern has been selected. Accordingly, when a buttonhole pattern is selected, a high signal is applied to the lead 133 to energize the light emitting diode 135. Thus, whenever a buttonhole pattern is selected or reselected, the AND gate 137 emits a pulse on its output line 139 to set the bistable element, or flip flop, 141. Normally, the flip flop 141 is in its reset state with a high output on the lead 143 and a low output on the lead 145. In this condition, neither the alarm 147 nor the needle bar release solenoid 68 are activated. The high signal on the lead 143 passes through the OR gate 149 to enable the AND gate 151 to pass timing pulses from the lead 113 to the count input line 111 of the address counter 109. These pulses are also applied to the reset input 153 of the flip flop 141 to keep the flip flop 141 in its reset state.

As was previously mentioned, when the buttonhole pattern is selected or reselected, a pulse is applied to the lead 139 which sets the flip flop 141, causing the lead 145 to go high. The high signal on the lead 145 is amplified by the driver 155 to energize the needle bar release solenoid 68 so as to unlatch the needle bar 62 and prevent the formation of stitches. Additionally, the high signal on the lead 145, after a suitable delay as determined by the delay element 157, activates the alarm 147 to alert the operator in the event that the paddle 30 and presser foot 16 are not properly positioned. With the flip flop 141 in its set state, there is a low signal on the lead 143, removing the high signal through the OR gate 149 to the AND gate 151. In this condition, the only way that the AND gate 151 can pass the armshaft timing pulses on the lead 113 is for the paddle 30 and the buttonhole presser foot 16 to be properly positioned. In that case, the movable contact 50 touches the fixed contact 42 so that a ground is applied to the lead 44, which ground is inverted by the inverter 159 to provide a high signal on the lead 161. The high signal on the lead 161 passes through the OR gate 149 to enable the AND gate 151 to pass armshaft timing pulses therethrough when the sewing machine is operated. The first armshaft timing pulse will reset the flip flop 141, which results in a permanent enabling signal on the lead 143. With the flip flop 141 being reset, the high signal will be removed from the lead 145, de-energizing the needle bar release solenoid 68. If this condition occurs before the time delay period of the delay element 157, the alarm 147 will not have been activated.

If the buttonhole pattern had been selected while the paddle 30 and buttonhole presser foot 16 had not been properly positioned, the flip flop 141 would have remained in its set state, maintaining the needle bar release solenoid energized and causing the alarm 147 to be activated. Therefore, even if the sewing machine were to be operated, the armshaft timing pulses on the lead 113 would not pass through the AND gate 151 and the address counter 109 would not be incremented. When the operator responds to the fact that stitches are not being formed and/or that an alarm had been activated, the operator then properly positions the paddle 30 and the buttonhole presser foot 16. When the machine is subsequently run, the next armshaft timing pulse on the lead 113 resets the flip flop 141, de-energizing the needle bar release solenoid 68, deactivating the alarm 147, and passing armshaft timing pulses to the count input line 113 of the address counter 109, resulting in the sewing of a buttonhole pattern.

Accordingly, there has been disclosed an improved arrangement for preventing the sewing of a buttonhole pattern if the sewing machine is not properly set up. It is understood that the above-described arrangement is merely illustrative of the application of the principles of this invention, and it is only intended that this invention be limited by the scope of the appended claims.

We claim:

1. In a sewing machine having stitch forming instrumentalities positionally controlled over a predetermined range between stitches to produce a pattern of feed and bight controlled stitches, static memory means for storing pattern stitch information, means for selecting a pattern to be sewn, timing pulse generating means for generating timing pulses in synchronisim with the operation of said sewing machine, means utilizing said timing pulses for recovering selected pattern stitch information from said static memory means, actuating means responsive to said pattern stitch information for influencing the feed and bight motions to produce a pattern of stitches corresponding to the selected pattern stitch information, a buttonhole presser foot including a button size gauging arrangement, a paddle switch adapted to cooperate with said button size gauging arrangement during the sewing of a buttonhole pattern so as to provide switching signals for forming an appropriate sized buttonhole, said paddle switch being selectively movable between a retracted non-operative position and an extended operative position, and inhibit means selectively operable for rendering inoperative at least one of the stitch forming instrumentalities, the improvement comprising:

signal generating means responsive to said paddle switch not being in its operative position when a buttonhole pattern is selected for generating a control signal; and means responsive to said control signal for operating said inhibit means.

2. The improvement according to claim 1 further including an alarm and means responsive to said control signal for activating said alarm to alert the sewing machine operator of an improper operating condition.

3. The improvement according to claim 1 further including means responsive to said control signal for preventing said timing pulses from reaching said means utilizing said timing pulses.

4. The improvement according to claim 1 wherein said paddle switch includes a switch contact adapted to be closed at the start of sewing of a buttonhole pattern when the paddle switch is in its extended position and the buttonhole presser foot is properly positioned, said signal generating means including:

a bistable element selectively settable to either a first or a second state;

means responsive to selection of the buttonhole pattern for setting said bistable element to said first state;

means responsive to closure of said switch contact for setting said bistable element to said second state; and means responsive to said bistable element being in said first state for generating said control signal.

5. The improvement according to claim 4 further including latching means responsive to said bistable element being in said second state for maintaining said bistable element in said second state irrespective of the condition of said switch contact.

6. The improvement according to claim 5 wherein said latching means includes means for preventing said timing pulses from reaching said means utilizing said timing pulses.

7. The improvement according to claim 1 wherein said inhibit means includes a skip stitch mechanism for preventing reciprocation of the needle bar and a solenoid which when energized operates said skip stitch mechanism, said means responsive to said control signal including means for energizing said solenoid.

* * * * *